US005096797A

United States Patent [19]

Yoerger

[11] Patent Number: 5,096,797

[45] Date of Patent: Mar. 17, 1992

[54] METHOD FOR IMPROVING PERFORMANCE OF BARIUM AND STRONTIUM FERRITE CARRIER PARTICLES WITH ACID WASH

[75] Inventor: William E. Yoerger, Rochester, N.Y.

[73] Assignee: Eastman Kodak Company, Rochester, N.Y.

[21] Appl. No.: 642,973

[22] Filed: Jan. 14, 1991

[51] Int. Cl.[5] ..... G03G 9/10

[52] U.S. Cl. ..... 430/108; 430/106.6; 430/137

[58] Field of Search ..... 430/106.6, 107, 108, 430/137

[56] References Cited

U.S. PATENT DOCUMENTS

| | | | |
|---|---|---|---|
| 3,607,750 | 9/1976 | Rarey et al. | 252/62.1 |
| 3,632,512 | 9/1971 | Miller | 430/108 |
| 3,716,630 | 2/1973 | Shirk | 423/594 |
| 3,718,594 | 2/1973 | Miller | 252/62.1 |
| 3,947,271 | 3/1976 | Munzel et al. | 427/14 |
| 4,147,834 | 4/1979 | Munzel et al. | 428/407 |
| 4,247,597 | 1/1981 | Russell, Jr. | 428/403 |
| 4,268,599 | 5/1981 | Russell, Jr. | 430/108 |
| 4,310,611 | 1/1982 | Miskinis | 430/107 |
| 4,546,060 | 10/1985 | Miskinis et al. | 430/108 |
| 4,737,435 | 4/1988 | Yoerger | 430/137 |

FOREIGN PATENT DOCUMENTS 2-140759 5/1990 Japan .

OTHER PUBLICATIONS

Derwent Abstract 90-084862/12.
Derwent Abstract 78-11088A/06.

*Primary Examiner*—Marion E. McCamish
*Assistant Examiner*—Rosemary Ashton

[57] ABSTRACT

In the electrographic developer compositions, the performance of strontium ferrite or barium ferrite carrier particles is improved by treating the carrier particles with an aqueous acid solution. This treatment reduces the tendency toward early life dusting of strontium or barium ferrites and prevents contamination of the toner particles.

6 Claims, No Drawings

METHOD FOR IMPROVING PERFORMANCE OF BARIUM AND STRONTIUM FERRITE CARRIER PARTICLES WITH ACID WASH

FIELD OF THE INVENTION

This invention relates to electrography and, more particularly, to a method for improving the performance of carrier particles for use in magnetic brush dry development of electrostatic charge images.

BACKGROUND

The term "electrography" and "electrographic" as used herein broadly include various processes that involve forming and developing electrostatic charge patterns on surfaces, with or without the use of light. They include electrophotography and other processes. One method of electrographic development is the magnetic brush method which is widely used for dry development in electrophotographic document copying machines. It is disclosed, for example, in U.S. Pat. No. 3,003,462. The method of the present invention is useful in preparing the carrier particles for two-component dry developers used in the magnetic brush method. Such a developer is a mixture of thermoplastic toner particles and magnetic carrier particles, the latter being partially coated with an insulating resin.

In the development station of a copying machine, the two-component developer, which includes the magnetic carrier particles, is attracted to a magnetic brush consisting of stationary magnets surrounded by a rotating cylindrical sleeve or a stationary sleeve surrounding rotating magnets, e.g., as in the patent to Miskinis et al., U.S. Pat. No. 4,546,060. By frictional contact with the resin-coated carrier particles the toner particles are triboelectrically charged and cling to the carrier particles, creating bristle-like formations of developer on the magnetic brush sleeve. In developing a charge pattern the brush is brought close to the charged surface. The oppositely charged toner particles are drawn away from the carrier particles on the magnetic brush by the more strongly charged electrostatic charge pattern, thus developing and making visible the charge pattern.

Although uncoated iron particles have been used as carriers in magnetic brush developers and although the high conductivity of uncoated iron particles is desirable because a conductive magnetic brush serves as a development electrode and improves the development of large solid areas in the image, nevertheless, resin-coated carrier particles have been preferred. One reason for resin-coating the carrier particles has been to improve the triboelectric charging of the toner particles. When a resin-coated carrier is used, the toner powder acquires an optimally high, net electrical charge because of the frictional contact of the toner particles and the resin coating. The high net charge reduces the amount of toner lost from the developer mix as it is agitated in the magnetic brush apparatus.

Especially useful as the carrier particles in two component developers are strontium and barium ferrites. However, a problem that has been encountered with magnetic ferrite carrier particles containing strontium and barium has been the contamination of the carrier particles with dust or fines in the form of strontium or barium oxides. When such a carrier is mixed with toner powder to form the two-component developer mixture, this dust deposits on the surfaces of the toner particles and reduces their ability to develop an electrostatic charge. An indication of such contamination is toner "throw-off" during the development process. Throw-off is the term used to describe toner particles that separate from the carrier before they are attracted to the more strongly charged photoconductor. This phenomena may also be described as "early life dusting."

In the past, a way of overcoming this problem has been to precondition the developer. This is done by agitating or "exercising" the developer mixture for a period of time before it is used for electrostatic image development and stripping off the contaminated toner particles. However, a problem can result from this technique in that the resinous toner particles tend to scum the carrier or pack into its pores. When this happens the capability of the carrier for triboelectric charging of the toner particles is adversely affected.

BRIEF SUMMARY OF THE INVENTION

In accordance with the present invention it has been found that reduction in the charging capability of the magnetic ferrite carrier particles can be avoided by a treatment of the particles with an aqueous acid solution. This treatment removes strontium-containing or barium-containing fines sufficiently that no further treatment to remove fines is necessary. Hence, the problem of scumming or pore-packing of the carrier particles is avoided and improved triboelectric charging of toner particles is made possible.

DETAILED DESCRIPTION

The electrographic developer carriers which are made by the method of this invention are strontium or barium ferrites. Ferrites, as used herein, are magnetic oxides containing iron as a major metallic component. The method of the invention is especially useful with ferrites of strontium or barium, such as $BaFe_{12}O_{19}$, $SrFe_{12}O_{19}$ and the magnetic ferrites having the formula $MO.6Fe_2O_3$, where M is barium or strontium.

These ferrite carriers are disclosed in U.S. Pat. No. 4,546,060 to Miskinis et al and U.S. Pat. No. 4,764,445 to Saha, both of which are incorporated herein by reference. Strontium and barium ferrites, being hard magnetic materials, are desirable as carrier particles. In their manufacture, however, a substantial amount of dust, in the form of strontium or barium oxides, forms on the ferrite carrier. It is the removal of this strontium or barium oxide dust with which the present invention is concerned.

Although the method of the present invention is suitable for treating bare carrier particles, it is especially effective on carrier particles that have been resin-coated to improve the triboelectric charging of the toner particles.

The resin with which the carrier particles are coated can be any of a large class of thermoplastic polymeric resins. Especially desirable are fluorocarbon polymers such as poly(vinylidene fluoride) and poly(vinylidene fluoride-co-tetra-fluoroethylene). Also, useful are the copolymers of vinylidene chloride with acrylic monomers which are disclosed in U.S. Pat. No. 3,795,617. Other examples include cellulose esters such as cellulose acetate and cellulose acetate butyrate, polyesters such as poly(ethylene terephthalate) and poly(1,4-butanediol terephthalate), polyamides such as nylon and polycarbonates, polyacrylates and polymethacrylates. Still other examples include the thermosetting resins and light-hardening resins described in U.S. Pat. No.

3,632,512; the alkali-soluble carboxylated polymers of U.S. Pat. No. Re. 27,912 (Reissue of U.S. Pat. No. 3,547,822); and the ionic copolymers of U.S. Pat. Nos. 3,795,618 and 3,898,170.

The ferrite carrier particles used in two-component developers normally are of larger size than the toner particles. Although irregular in shape, they have, for example, an average diameter from 10 to 500 microns and preferably from 10 to 100 microns and most preferably, 20 to 60 microns. To obtain particles of the desired particle size range, a convenient way is to screen a mass of particles with standard screens. Particles that pass through a 100 mesh screen and are retained on a 600 mesh screen (U.S. Sieve Series) are especially suitable.

In coating the ferrite carrier particles with resin the carrier particles are mixed with finely-divided powdered resin. The particle size of the powdered resin can vary considerably but should be smaller than the particle size of the carrier particles. The resin particles can range in average diameter from 0.01 to 50 microns although a particle size from 0.05 to 10 microns is preferred.

The amount of resin powder relative to the amount of carrier particles can vary over a considerable range, but preferably, is from 0.05 to 5 weight percent. By using such a small amount of resin it is possible to form a discontinuous resin coating or a very thin resin coating on the ferrite particles and retain good conductivity in accordance with the invention.

To dry-mix the carrier particles and resin particles, they preferably are tumbled together in a rotating vessel. This dry mixing should continue preferably for several minutes, e.g., for 5 to 30 minutes. Other methods of agitation of the particles are also suitable, e.g., mixing in a fluidized bed with an inert gas stream, or mixing by a mechanical stirrer.

After dry mixing the carrier particles and resin powder as described, the resin is bonded to the carrier particles, for example, by heating the mixture in an oven at a temperature and for a time sufficient to achieve bonding.

In accordance with the present invention, it has been found that the treatment of the ferrite carrier particles with an aqueous acid solution dissolves any contaminating loose strontium or barium oxide dust. This creates an extremely clean ferrite carrier which is free from the toner scumming that would otherwise occur in a developer preconditioning step. The carrier, therefore, can create an optimally high triboelectric charge and produces very little toner "throw-off" when used.

U.S. Pat. Nos. 3,632,512 and 3,718,594 to Miller disclose acid washing of iron carrier particles to provide carriers that are magnetically responsive and have homogeneous surfaces, free of oxidation. There is no suggestion, however, of strontium ferrite or barium ferrite carriers nor that washing such carriers with an aqueous acid solution will solve the problem of early life dusting to which they are susceptible. Also, Miller does not suggest acid washing after resin coating, which is the preferred sequence of the present invention.

The acid solutions used in the method of the invention can be any aqueous solution of an acid of sufficiently low pH. Useful acids thus include hydrochloric acid, sulfuric acid, nitric acid, hydrofluoric acid, phosphoric acid, acetic acid, oxalic acid, citric acid and mixtures thereof. Especially useful is a mixture of four parts by weight of acetic acid to one part nitric acid. A suitably low pH is 3 or less, with a pH of 1.5 or less being preferred. Advantageously, the acid solution can also include a water-miscible alcohol such as a lower alkanol, and, preferably, methanol or ethanol or a surfactant such as "Triton X-100" supplied by Rohm & Haas Co., which is identified as octylphenoxy-poly(ethoxyethanol).

The treatment of the ferrite carrier with the acid solution can be accomplished by soaking the carrier particles in the acid solution for half an hour or more at ambient temperature and filtering the mixture to recover the carrier particles which are then rinsed with water to remove all acid. Preferably, the rinse water contains an alcohol or a surfactant to improve the wetting of the hydrophobic, resin-coated carrier particle surface. Suitable surfactants for the rinse water include the non-ionic surfactants in a concentration, e.g., of 0.5% to 0.01% weight percent. A preferred surfactant is Triton X-100 as disclosed above which can be used, for example, in concentrations from about 0.25 to 0.5 weight percent. After rinsing with water which contains a surfactant it is important then to rinse the carrier particles with water or alcohol alone because residual surfactant will cause a decrease in the charging capability of the carrier.

The acid washed, ferrite carrier particles of the present invention are mixed with powdered toner particles to form a two-component developer that has a much reduced tendency toward early life dusting. Useful toners include powdered polymeric compositions made from various thermoplastic and thermoset binder resins such as polyacrylates, polystyrene, poly(styrene-co-acrylate), polyesters, phenolics and the like. The binder resin can be blended with colorants such as carbon black or organic pigments or dyes. Other additives such as charge-control agents and surfactants can also be included in the toner composition.

Examples of suitable toners include the polyester toner compositions of U.S. Pat. No. 4,140,644; the polyester toners having a p-hydroxybenzoic acid recurring unit of U.S. Pat. No. 4,446,302; the toners containing branched polyesters of U.S. Pat. No. 4,217,440 and the crosslinked styrene-acrylic toners and polyester toners of U.S. Pat. No. Re. 31,072. Useful charge-control agents include the phosphonium charge agents of U.S. Pat. Nos. 4,496,643 and the ammonium charge agents of U.S. Pat. Nos. 4,394,430; 4,323,634, and 3,893,935.

Especially useful with the acid treated ferrite carrier is a toner of which the binder is a complex polyester of terephthalic acid, glycerol, glutaric acid, and 1,2-propanediol.

The following examples further illustrate the method of the invention.

EXAMPLES

Examples 1-5 demonstrate the effect of acid treatment in reducing early life dusting while maintaining a favorable charge to mass ratio. Developers formed by mixing toners with acid-washed, resin-coated ferrite carrier particles were tested for throw-off, which is indicative of early life dusting. In that test, the developer is placed in a magnetic brush developer station which is connected by way of a filter to a vacuum. As the magnets of the brush rotate and agitate the developer, any toner which separates from the carrier is drawn off by the vacuum and collects on the filter. The weight of toner on the filter after a selected period of time shows the extent of dusting or throw-off of toner. To simulate long life developer behavior, the charge-to-mass ratio of the carriers is tested under three conditions:

(1) Fresh developer: the developer is prepared at an initial toner concentration of 12 weight percent (12% TC) and tested without prior use.

(2) Exercised developer (5 minutes): before testing, the developer at 12% TC is exercised for five minutes by tumbling 1 g of developer in a 4 dram screw-cap vial placed in the rotating magnetic field (2000 rpm, core rotation only) of a magnetic brush developing station.

(3) Exercised developer (10 minutes): same as above except the developer at 12% TC is exercised for ten minutes.

Charge-to-mass ratio is measured as follows. Toner and carrier particles are separated by the combined action of magnetic agitation of the developer mixture and an electric field. The developer is charged by shaking in a mechanical shaker for 180 seconds. Between 0.05 and 0.1 g of the charged developer are placed in a sample dish. A 60 Hz alternating current magnetic field and an electric field of approximately 2,000 volts/cm are applied for thirty seconds.

Toner is released from the carrier as a result of the mechanical agitation of the developer and such toner is transported to an upper plate by the electric field. The charge on the toner is recorded with an electrometer and the weight of the toner collected on the plate is measured. Toner charge-to-mass ratio is calculated by dividing the charge on the toner by the mass of the toner.

To further simulate long life developer behavior, the developer at 12% TC which is exercised for ten minutes, is replenished by exercising for two minutes with additional fresh toner to give an 18% TC. The developer at 18% TC is exercised for one minute over a magnetic brush and toner drawn off by the vacuum onto the filter paper is weighed. This amount is the throw-off.

In all examples the toner used is a cyan-pigmented polyester toner, the polyester being a complex polyester of terephthalic acid, glycerol, glutaric acid, and 1,2-propanediol. The resin coating in each example contains "Kynar 301F" poly(vinylidene fluoride) resin, (PVF), supplied by the Pennwalt Corporation or a mixture of that resin with poly(methyl methacrylate).

EXAMPLE 1

100 g of strontium ferrite carrier particles, coated with a 1:1 weight ratio blend of methyl methacrylate and PVF resin was placed on a roll mill in a 250 ml bottle with an aqueous solution containing hydrochloric acid in varying concentrations and 20 volume percent methanol. In each case, the pH of the acid is less than one.

The ferrite carrier particles are stirred in the acid solution for three hours and then filtered, washed with a 4:1 volume ratio mixture of distilled water and methanol, reslurried approximately six times with approximately 400 ml of a 4:1 volume ratio mixture of distilled water and methanol (decanted each time), rinsed on a filter with 100% methanol and then dried.

The dried carrier particles are mixed with the toner and charge-to-mass ratio and throw-off is measured as described above. An unwashed sample was used as a control. Table I below lists the results.

TABLE I

| HCl Acid Conc. | Charge-to-mass ratio (Q) (microcoulomb/g) Fresh | 5 Min. | 10 Min. | Δ Q (after 10 minutes) (microcoulomb/g) | Throw-off (mg) |
|---|---|---|---|---|---|
| None | 22.5 | 8.3 | 5.4 | 17.1 | 65 |
| 7.5% | 31.8 | 18.8 | 17.7 | 13.1 | 0.5 |
| 10% | 29.5 | 22.3 | 18.0 | 11.5 | 0.3 |
| 15% | 24.1 | 22.9 | 18.8 | 5.3 | 0.4 |
| 20% | 26.3 | 24.0 | 20.4 | 5.9 | 0.3 |

Table I shows the results of the charge-to-mass ratio and throw-off measurements on untreated ferrite carrier particles (used as a control) and carrier particles treated with hydrochloric acid. Dramatic improvement in throw-off is shown after acid washing while also improving the net charge-to-mass ratio after exercise of the developer.

EXAMPLE 2

Resin-coated strontium ferrite carrier particles are treated according to methods and materials of Example 1, substituting the variable hydrochloric acid concentrations of Example 1 with a series of strong acids, each in 15 volume percent concentration. In each case, the pH of the acid is less than one.

TABLE II

| Acid Treatment | Charge-to-mass ratio (Q) (microcoulomb/g) Fresh | 5 Min. | 10 Min. | Throw-Off (mg) |
|---|---|---|---|---|
| None | 24 | 8.2 | 5.3 | 65.1 |
| HCl | 27 | 22.1 | 18.6 | 0.4 |
| $H_2SO_4$ | 32.7 | 21 | 17.7 | 0.5 |
| $HNO_3$ | 34.6 | 21 | 16.8 | 0.3 |
| $H_3PO_4$ | 34.5 | 21.7 | 18.5 | 0.3 |

Table II demonstrates that favorable throw-off measurements are achieved with various strong acids as well as with hydrochloric acid.

EXAMPLE 3

Resin-coated strontium ferrite carrier particles are treated according to the method and materials of Example 1, this time substituting the variable hydrochloric acid concentrations of Example 1 with a series of weaker acids. The concentration and pH of each acid, as well as the length of time of treatment, are shown in Table III.

TABLE III

| Acid Treatment | Hours of Treatment | Conc. (wt %) | pH | Charge-to-mass ratio (Q) microcoulomb/g Fresh | 10 min | Throw-off (mg) |
|---|---|---|---|---|---|---|
| None | 0 | — | — | 17.0 | 5.3 | 82.8 |
| $FeCl_3.6H_2O$ | 3 | 10 | 1.19 | 31.6 | 16.4 | 0.2 |
| Oxalic | 3 | 15 | 0.81 | 32.8 | 15.3 | 0.5 |
| Citric | 3 | 15 | 1.55 | 30.2 | 16.6 | 0.2 |
| Acetic | 1 | 15 | 2.2 | 30.1 | 15.2 | 0.2 |
| Acetic | 3 | 15 | 2.2 | 25.2 | 14.3 | 0.3 |
| Acetic/ | 1 | 15 | 0.59 | 29.3 | 15.0 | 0.6 |

TABLE III-continued

| Acid Treatment | Hours of Treatment | Conc. (wt %) | pH | Charge-to-mass ratio (Q) microcoulomb/g Fresh | 10 min | Throw-off (mg) |
|---|---|---|---|---|---|---|
| Nitric (9:1 weight ratio) | | | | | | |

Table III illustrates that weaker acid solutions are likewise capable of dramatically reducing throw-off of toner from ferrite carrier cores.

EXAMPLE 4

Resin-coated strontium ferrite carrier particles are treated with 15 volume percent hydrochloric acid according to the method and materials of Example 1, this time varying the concentration of the resin coating. In this example, the coating comprises only PVF resin. For each concentration of PVF resin, unwashed carrier cores are measured for charge-to-mass ratio and throw-off, followed by measurements on an acid-washed sample. Table IV records the results. In the table, "PPH" means parts by weight of resin per hundred parts of carrier.

TABLE IV

| PPH Resin | Treat-ment | Charge-to-mass ratio (Q) (microcoulomb/g) Fresh | 5 Min. | 10 Min. | Throw-Off (mg) |
|---|---|---|---|---|---|
| 2 PPH | — | 57.7 | 26.3 | 18.7 | 2.6 |
| 2 PPH | 15% HCl | 47.9 | 32.1 | 26.1 | 0.2 |
| 1 PPH | — | 52.0 | 15.0 | 10.0 | 86.8 |
| 1 PPH | 15% HCl | 40.4 | 21.5 | 17.2 | 1.2 |
| 0.5 PPH | — | 47.0 | 8.4 | 4.7 | 139.4 |
| 0.5 PPH | 15% HCl | 33.8 | 15.3 | 12.2 | 58.3. |

Table IV demonstrates decreases in toner throw-off after acid washing in each case. The decrease in throw-off is especially dramatic in resin concentrations of 1 part per hundred and above.

EXAMPLE 5

Resin-coated strontium ferrite carrier particles are treated according to the method and materials of Example 1, this time coating the strontium ferrite carriers variably with two parts per hundred PVF resin, two parts per hundred PVF resin mixed with 0.7 parts per hundred carbon black, and two parts per hundred of a 1:1 weight ratio mixture of PVF resin and methyl methacrylate. Carbon black and methyl methacrylate are additives used to adjust the charge of the coated carrier particles. Table V lists the results.

TABLE V

| PPH Resin | Treat-ment | Charge-to-mass ratio (Q) (microcoulomb/g) Fresh | 5 Min. | 10 Min. | Throw-Off (mg) |
|---|---|---|---|---|---|
| 2 PPH | — | 57.7 | 26.3 | 18.7 | 2.6 |

TABLE V-continued

| PPH Resin | Treat-ment | Charge-to-mass ratio (Q) (microcoulomb/g) Fresh | 5 Min. | 10 Min. | Throw-Off (mg) |
|---|---|---|---|---|---|
| | HCl | 47.9 | 32.1 | 26.1 | 0.2 |
| 2 PPH to | — | 31.5 | — | 4.3 | 151.1 |
| 0.7 PPH carbon black | HCl | 33.1 | — | 15.8 | 1.7 |
| 2 PPH total of equal parts methyl methacrylate and $PVF_2$ resin | — | 22.5 | 8.3 | 5.4 | 65 |
| | HCl | 24.1 | 22.9 | 18.8 | 0.4 |

Table IV demonstrates the effectiveness of acid washing the carrier particles when a variety of different additives are mixed with the $PVF_2$ resin. The throw-off and net charge-to-mass ratio showed improvement over the untreated carrier particles in each case.

The invention has been described with reference to certain preferred embodiments, but it will be understood that variations and modifications can be made within the spirit and scope of invention.

I claim:

1. A method for forming an electrographic developer composition containing magnetic strontium ferrite or barium ferrite carrier particles which comprises:

washing said ferrite carrier particles with an aqueous acid solution and, thereafter, mixing the acid-washed ferrite carrier particles with toner particles and obtaining a developer composition having reduced tendency toward early life dusting.

2. The method of claim 1 wherein the acid solution has a pH of 3 or less.

3. A method according to claim 2 wherein the ferrite carrier particles are coated with a polymer comprising a poly(vinylidene fluoride) resin, a polymethacrylate, a polyacrylate or a polyester.

4. A method according to claim 3 wherein the acid is hydrochloric acid, nitric acid, sulfuric acid, phosphoric acid, or a combination thereof with acetic acid.

5. A method according to claim 4 wherein the resin-coated ferrite particles are treated first with an strong acid solution, then rinsed with a solution of water and a lower alkanol or a surfactant and thereafter with water or lower alkanol.

6. A method of preparing resin-coated magnetic carrier particles which comprises mixing strontium or barium ferrite particle with a powdered thermoplastic resin, heating the mixture to fuse the resin as a surface coating on the ferrite particles and thereafter washing the resin-coated particles with an aqueous acid solution.

* * * * *